US006119681A

United States Patent [19]

Lilke

[11] Patent Number: 6,119,681

[45] Date of Patent: Sep. 19, 2000

[54] BUTANE HEATED MULTIPURPOSE TOOL INCLUDING GLUE GUN FUNCTION

[76] Inventor: Harvey Lilke, P.O. Box 1043, Winnipeg, Manitoba, Canada, R3C 2X4

[21] Appl. No.: 08/834,143

[22] Filed: Apr. 14, 1997

Related U.S. Application Data

[60] Provisional application No. 60/015,518, Apr. 16, 1996.

[51] Int. Cl.[7] ..... F24J 7/00

[52] U.S. Cl. ..... 126/401; 126/404; 126/406; 126/407; 126/409; 126/413; 126/414

[58] Field of Search ..... 126/401, 413, 126/404, 406, 409, 407, 414; 431/268

[56] References Cited

U.S. PATENT DOCUMENTS

| | | | |
|---|---|---|---|
| 4,795,064 | 1/1989 | Shibata et al. | 126/409 X |
| 4,949,881 | 8/1990 | Watanabe et al. | 126/401 X |
| 5,055,033 | 10/1991 | Lee | 431/255 |
| 5,094,611 | 3/1992 | Suppiah et al. | 126/414 X |
| 5,215,076 | 6/1993 | Oglesby et al. | 126/413 |
| 5,479,914 | 1/1996 | Tsai | 126/401 |

*Primary Examiner*—Larry Jones
*Attorney, Agent, or Firm*—Adrian D. Battison; Murray E. Thrift

[57] ABSTRACT

A cordless tool which includes a glue gun function and may include other functions includes a sleeve for receiving a stick of hot melt glue for sliding through the sleeve and a tip at the forward end of the sleeve for discharging the glue when melted. A butane heated gas burner heats the sleeve using gas permeable catalytic heater which surrounds or lies in intimate contact with the sleeve to communicate heat to the sleeve. The arrangement can be modified by closing off the catalytic heater for use to provide multi function.

9 Claims, 4 Drawing Sheets

BUTANE HEATED MULTIPURPOSE TOOL INCLUDING GLUE GUN FUNCTION

This application claims benefit of provisional application Ser. No. 60/015,518 filed Apr. 16, 1996.

BRIEF DESCRIPTION OF THE INVENTION

This invention relates to a cordless tool which can be a multipurpose tool including a not melt glue gun function of a type which avoids the necessity for electric power or can be simply a cordless glue gun depending upon the design preferred.

Glue guns are well known which use electric power to heat a sleeve through which a stick of hot melt glue can be fed so that the stick melts within the sleeve to allow the gun to squeeze the melted glue through a nozzle tip for effecting a hot melt gluing action.

Proposals for cordless hot melt glue guns have previously been made in which the electric power is supplied by rechargeable battery. This is however inconvenient and relatively heavy.

It is one object of the present invention, therefore, to provide an improved cordless tool which includes a hot melt glue gun function.

According to one aspect of the invention there is provided a cordless glue gun comprising a sleeve for receiving a stick of hot melt glue for sliding therethrough, a tip at a forward end of the sleeve for discharging the glue when melted, and a gas burner for heating the sleeve so as to melt the glue.

BRIEF DESCRIPTION OF THE DRAWINGS

One embodiment of the invention will now be described in conjunction with the accompanying drawings in which.

DETAILED DESCRIPTION OF THE INVENTION

Figure 1:
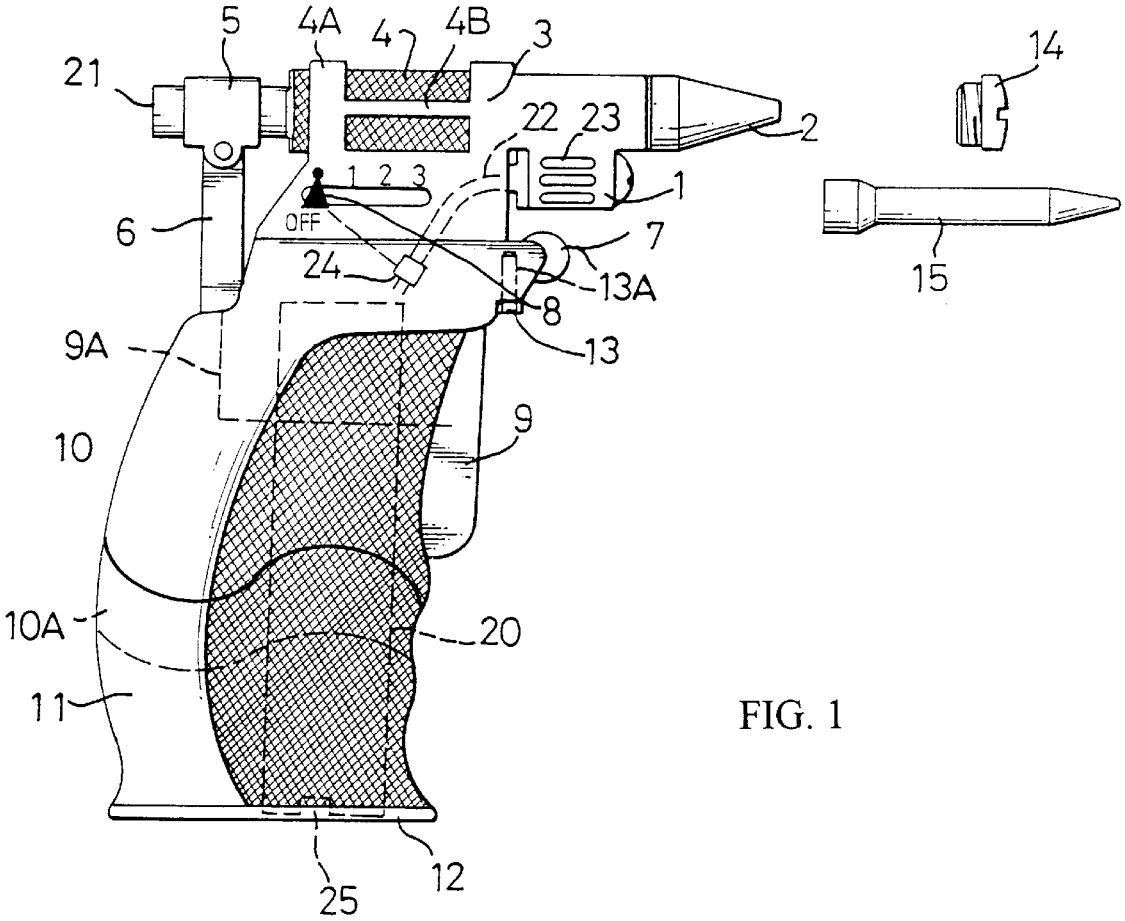
FIG. 1 is a side elevational view of a first embodiment of the invention.

Referring firstly to FIG. 1, the apparatus as shown comprises a housing including an upper housing part 10 and a lower housing part 11 which can be engaged onto a portion 10A of the upper housing part as a sliding or friction fit so that the parts clip together to enclose a hollow interior. A reservoir or container 20 of butane is provided within the hollow interior of the housing. At the top of the housing is mounted a glue dispensing system including a metal sleeve 3 which acts as a thermal body and guide support for a glue stick 21 to be fed through the sleeve 3 to a replaceable metal discharge nozzle 2 at a forward end of the sleeve 3.

Behind the sleeve 3 is mounted a plastics tube 4 which can be formed of fiberglass or similar material and acts as an insulator to prevent the heat from the sleeve 3 from communicating along the glue stick to a rear part of the glue stick. Only a forward part of the glue stick which is within the sleeve 3 and within the nozzle 2 is therefore heated and can be discharged from a forward end of the nozzle 2. The plastic sleeve 4 is support in a rear collar 4A mounted on the housing and coaxial with the sleeve 3. A strap 4B interconnects the sleeve 3 and the collar 4A. The glue stick is moved forwardly by a stick advancing collar 5 carried on an actuating arm 6. The arm 6 is reciprocated by a trigger 9 through a linkage 9A so that the reciprocation of the arm 6 causes a pushing action on the glue stick 21 as the collar moves forwardly and allows the collar to be retracted over the glue stick in the return direction of reciprocation for a further pushing stroke.

On the underside of the sleeve 3 integrally connected therewith or in intimate contact therewith is provided a catalytic heater 1 of the type comprising a surrounding sleeve of metal containing a porous catalytic material so that injection of the gas from a feed line 22 into one end of the sleeve causes the gas to be fed into the porous material and allows the gas to be burned within the porous material with the combustion products escaping through holes or slots 23 in the outside of the sleeve surrounding the catalytic material. Thus the injection of the gas into the catalytic burner can be ignited by an igniter wheel 7 of conventional construction located underneath the burner 1 so that heat from the burner is applied directly to the sleeve to effect heating of the sleeve throughout the full extent of the sleeve so as to heat the glue stick within the sleeve to effect melting of the glue within the sleeve. The igniter wheel 7 includes a flint replacement screw 13 containing a flint 13A so that rotation of the wheel generates sparks from the flint to effect lighting of the burner.

The supply line 22 includes a valve 24 which is actuated by a heat control dial or switch 8 which has a number of positions movable from a first off position in which the valve is closed through minimum open to maximum open positions in a number of selectable steps.

The lower housing portion 11 includes a base 12 which allows the element to be positioned in standing position on a support surface. At the base, a portion of the container 20 is exposed to provide a filler opening 25.

The tip 2 can be removed and replaced by a plug 14 so as to close off the sleeve 3 and prevent the use of the device as a glue gun. The burner 1 can be removed and replaced by one of a plurality of interchangeable tips 15 which provide a number of different tools or uses for example a soldering iron, a hot knife, a blow torch or a heat blower.

The tool therefore is completely cordless and powered by butane or other similar gas material and has the possibility for use either as a glue gun or as a tool providing one of the other uses set forth above.

Figure 2:
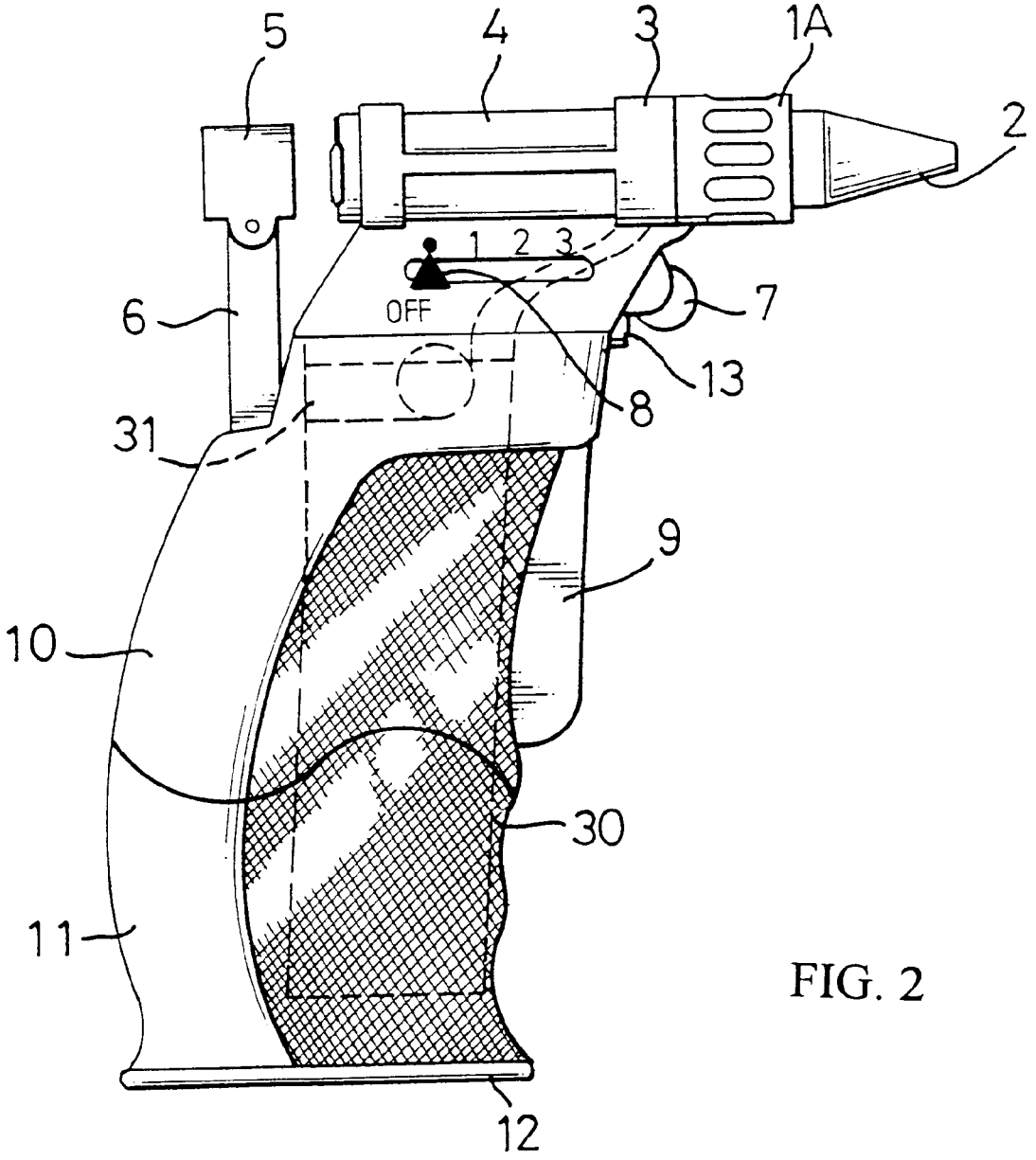
FIG. 2 is a side elevational view of a second embodiment of the invention.

In FIG. 2 is shown a similar arrangement but in this case the burner 1A surrounds the sleeve 2 so as to provide more direct heating of the sleeve 3. In addition the housing contains a conventional cigarette lighter 30 which is used as a removable reservoir for the gas supply. In this arrangement the control of the amount of gas can be effected by operating the conventional control lever on the lighter so that the switch 8 is used solely as a control for operating the compression of the conventional switch 31 on the lighter.

Figure 3:
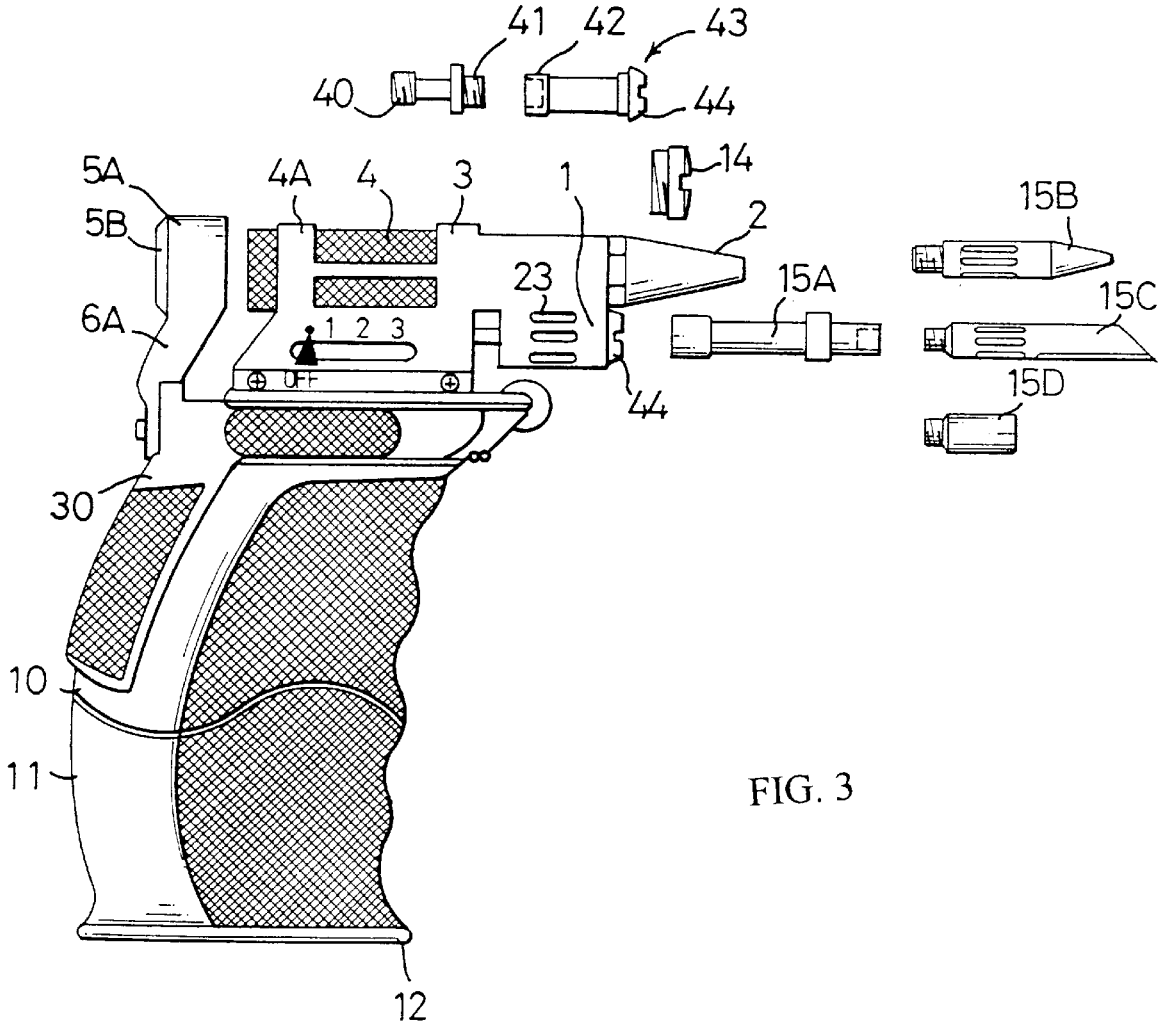
FIG. 3 is a side elevational view of a third embodiment of the invention.
Figure 4:
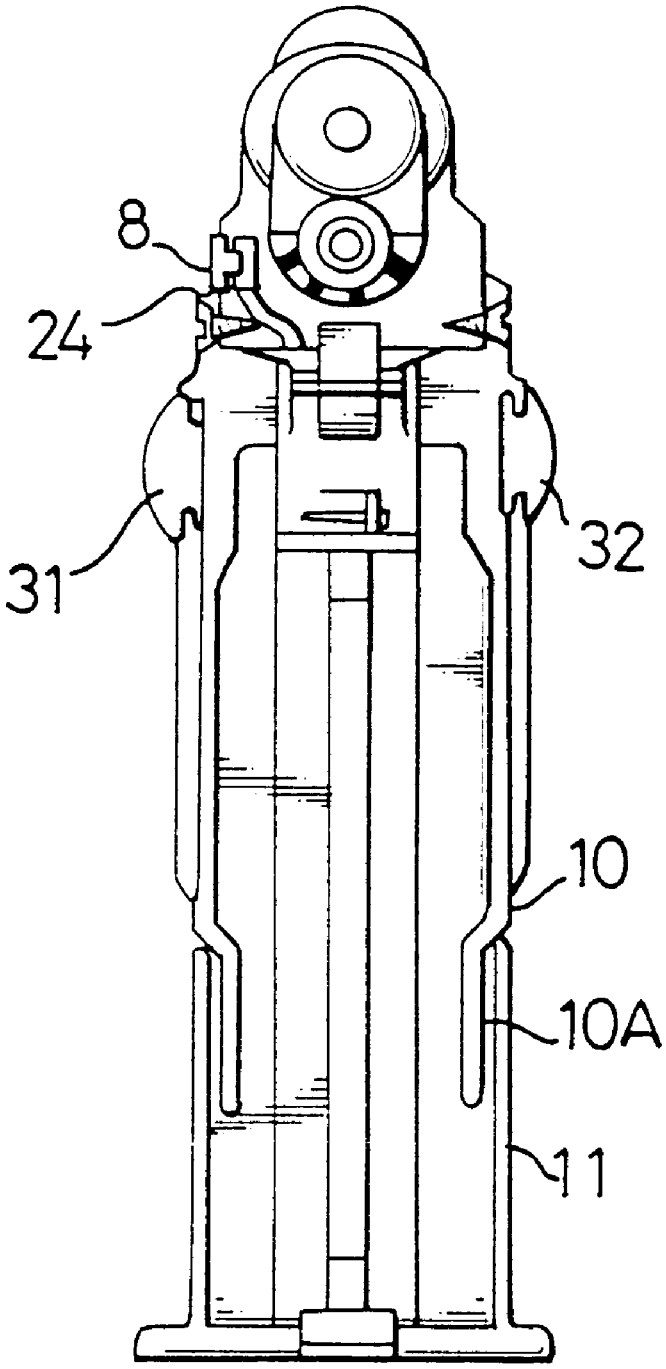
FIG. 4 is a front elevational view of the embodiment of FIG. 3 showing the housing partly in cross-section.

FIGS. 3 and 4 show a yet further embodiment similar to the embodiment of FIG. 1 but modified by the following features.

Firstly the trigger 9 and linkage 9A are replaced by a breach pad 30 which includes two sliding side guides 31 and 32 each slidable within a rail or recess in the side wall of the housing so as to guide the breach pad in forward and rearward movement relative to the housing. The breach pad carries an arm 6A which stands normally upwardly from the breach pad but can be twisted to one side to allow insertion of a glue stick. The arm 6A carries a collar 5A with an end plate 5B which abuts the end of the glue stick and applies forward pressure when the pad 30 is pressed forwardly by a squeezing action of the hand of the user relative to finger grooves in a front of the housing. Thus the sliding breach loader is retracted to fit a glue stick into the fiber guide 4. Once loaded the glue stick is manually fed forwardly by exerting slightly palm pressure against the breach pad.

When operating the glue gun, the butane gas adjust slide control 8 is operated to set the gas flow at maximum setting of three. The ignition wheel 7 is rotated to ignite the gas at the openings 23 in the burner. Once the tip is heated sufficiently, the slide control can be slightly reduced to prevent overheating of the glue stick. The fluidity of the glue stick can be determined by squeezing a small portion from the tip 2 and can be adjusted by effecting movement of the slide control 8 between the minimum and maximum settings.

In addition in FIG. 3, the construction of the burner 1 is shown in a little more detail in the exploded view. Thus the burner 1 includes a gas injector 40 which is located in the housing with a screw threaded end engaged into the housing and a forward end projecting into the interior of the burner 1. The forward end includes a threaded coupling 41 which receives a rear end 42 of a catalytic heater valve. Thus the sleeve forming the burner remains in place attached to the sleeve 3 or integral therewith so as to allow direct communication of heat. However the valve carrying the porous catalytic material can be inserted into the sleeve and screwed into engagement with the threaded coupling 41 of the injector 40. A screw head 44 of the valve allows the screwing action and this is visible at the front of the sleeve. The valve 43 can be removed and replaced when worn.

When it is intended to use the device for purposes other than the glue gun, the tip 2 is removed and replaced by the end plug 14. In addition the valve 43 is removed and is replaced by one of the replaceable tips 15A, 15B, 15C and 15D.

The tip 15A comprises a blow torch so that it does not use the catalytic burner arrangement but instead comprises a tube which is inserted into the sleeve of the burner and is threadedly engaged onto the coupling 41 of the injector. A forward end of the tip 15A projects outwardly from the sleeve of the burner and provides a conventional blow torch nozzle so that the gas is ignited at the front of the blow torch nozzle and does not in any way heat the burner 1.

The tip 15B comprises a soldering tip which again is inserted into the sleeve of the burner and coupled onto the coupling 41. In this case the catalytic burner section of the tip is aligned with the sleeve of the burner so that the gas combustion products can escape while heating the tip 15B so that a forward end is heated for soldering purposes.

The tip 15C comprises a cutting knife which is similar in construction to the tip 15B but includes at the forward end a knife blade which is heated by the catalytic burner. The tip 15D comprises simply an insertion into the sleeve of the burner so that the gas emerges from the front end of the burner without escaping through the openings 23 and can be ignited at the front of the burner. Appropriate temperature setting is achieved by the slide control 8 as previously described.

I claim:

1. A cordless glue gun arranged for multi-purpose use comprising:

a housing having a handle by which the housing can be manipulated;

a sleeve mounted on the housing for receiving a stick of hot melt glue for sliding therethrough;

a removable dispensing tip at a forward end of the sleeve for discharging the glue when melted;

an arrangement for supply of combustible gas mounted on the housing manually operable to control supply of the gas;

a gas heater for burning the combustible gas so as to effect heating the sleeve so as to melt the glue;

a plug for mounting on the sleeve in replacement for the removable dispensing tip for closing the forward end of the sleeve;

and a plurality of replacement tips each having a different function and each operable, in replacement for the heater, for burning the combustible gas, each replacement tip being arranged, when effecting the respective function, to direct heat away from the sleeve such that the sleeve is not heated during use of the replacement tip.

2. The glue gun according to claim 1 wherein the gas heater comprises a gas permeable catalytic heater with means for injecting the gas into the gas permeable catalyst and a plurality of openings for releasing combustion products such that the catalyst heats the sleeve.

3. The glue gun according to claim 2 wherein the catalytic heater at least partly surrounds the sleeve.

4. The glue gun according to claim 2 wherein the catalytic heater is arranged along one side of the sleeve in intimate contact therewith.

5. The glue gun according to claim 4 wherein the catalytic heater is integral with at least a part of the sleeve.

6. The glue gun according to claim 1 wherein the sleeve includes a rear portion thereof which is formed of a non-metallic material so as to have a lower thermal conductivity such that the glue is melted at a position only adjacent the tip at the forward end.

7. The glue gun according to claim 6 wherein the rear sleeve portion is formed of a plastics tube.

8. The glue gun according to claim 7 including a support collar surrounding the plastics tube at an end thereof remote from the tip.

9. The glue gun according to claim 1 wherein the housing includes a manually operable element having a linkage operable to drive the stick forward toward the dispensing tip.

* * * * *